US011634315B2

(12) United States Patent
Brule et al.

(10) Patent No.: US 11,634,315 B2
(45) Date of Patent: Apr. 25, 2023

(54) MACHINE FOR DISTRIBUTING A LIQUID OR PASTY PRODUCT

(71) Applicant: FILLON TECHNOLOGIES, Faverolles (FR)

(72) Inventors: Aurélien Brule, Chartres (FR); Nicolas Hiblot, Abondant (FR); Cyril Papin, Le Boulay-Mivoye (FR)

(73) Assignee: FILLON TECHNOLOGIES, Faverolles (FR)

( * ) Notice: Subject to any disclaimer, the term of this patent is extended or adjusted under 35 U.S.C. 154(b) by 0 days.

(21) Appl. No.: 17/435,550

(22) PCT Filed: Mar. 9, 2020

(86) PCT No.: PCT/FR2020/050470
§ 371 (c)(1),
(2) Date: Sep. 1, 2021

(87) PCT Pub. No.: WO2020/183098
PCT Pub. Date: Sep. 17, 2020

(65) Prior Publication Data

US 2022/0055887 A1 Feb. 24, 2022

(30) Foreign Application Priority Data

Mar. 11, 2019 (FR) ..... 19 02441

(51) Int. Cl.
*B67D 3/00* (2006.01)
*B67D 7/02* (2010.01)
(Continued)

(52) U.S. Cl.
CPC ..... *B67D 3/0041* (2013.01); *B67D 3/0003* (2013.01); *B67D 7/0288* (2013.01); *B67D 7/3227* (2013.01); *B67D 7/78* (2013.01)

(58) Field of Classification Search
CPC ..... B67D 7/78; B67D 7/0288; B67D 7/3227; B67D 3/0003
See application file for complete search history.

(56) References Cited

U.S. PATENT DOCUMENTS 4,705,083 A 11/1987 Rossetti
5,038,839 A * 8/1991 Morimoto ..... G01G 15/006 141/83

(Continued)

FOREIGN PATENT DOCUMENTS

| | | |
|---|---|---|
| DE | 202017102439 | 5/2017 |
| EP | 0372460 | 6/1990 |
| WO | 2018198149 | 11/2018 |

OTHER PUBLICATIONS

International Search Report dated Sep. 11, 2020.

*Primary Examiner* — Timothy L Maust
(74) *Attorney, Agent, or Firm* — Ipsilon USA, LLP

(57) ABSTRACT

Machine (1) for distributing a product stored in a container (30) comprising a storage zone (2) delimiting locations (4) for housing a container (30), a metering station (5) delimiting a chamber (6) housing a support (7) for accepting a collecting vessel (33), this support (7) being positioned vertically in line with an opening (8) providing access to the chamber (6), which opening is arranged in an upper part (61) of the chamber (6), the machine (1) further comprising a system (10) for emptying each location (4) for housing a container (30) through the opening (8) providing access to the chamber (6), and a unit (14) for controlling the machine (1). The metering station (5) comprises a sensor (13) for detecting the presence of a collecting vessel (33) inside said chamber (6). The control unit (14) is configured to operate the machine (1) on the basis of data supplied by said sensor (13), and the metering station (5) is equipped with a circuit (15) for the circulation of gaseous fluid providing commu- (Continued)

nication between the chamber (6) and the outside of said chamber (6) through a forced circulation of air.

14 Claims, 6 Drawing Sheets

(51) Int. Cl.
*B67D 7/32* (2010.01)
*B67D 7/78* (2010.01)

(56) References Cited

U.S. PATENT DOCUMENTS

| | | | | |
|---|---|---|---|---|
| 5,950,874 | A * | 9/1999 | Sindoni | B01F 33/841 222/325 |
| 6,672,341 | B2 * | 1/2004 | Bartholomew | B65B 25/00 222/144 |
| 7,347,344 | B2 * | 3/2008 | Engels | B01F 35/2117 222/105 |
| 7,527,078 | B2 * | 5/2009 | Driessen | B01F 35/881 141/83 |
| 8,176,950 | B2 * | 5/2012 | Luchinger | G01F 11/00 141/83 |
| 11,235,299 | B2 * | 2/2022 | Orsita | B01F 35/716 |
| 2003/0060925 | A1 * | 3/2003 | Bartholomew | G07F 11/52 700/231 |
| 2007/0084520 | A1 | 4/2007 | Driessen et al. | |
| 2008/0190513 | A1 * | 8/2008 | Luechinger | G01F 13/001 141/75 |

* cited by examiner

MACHINE FOR DISTRIBUTING A LIQUID OR PASTY PRODUCT

RELATED APPLICATION

This application is a National Phase of PCT/FR2020/050470 filed on Mar. 9, 2020, which claims the benefit of priority from French Patent Application No. 19 02441, filed on Mar. 11, 2019, the entirety of which are incorporated by reference.

FIELD OF THE INVENTION

The invention relates to a machine for dispensing liquid or pasty product, notably paint tint product, stored in a container, for the preparation of specific formulae.

It relates more particularly to a machine for dispensing product, in particular liquid product, stored in a container comprising a storage zone delimiting a plurality of locations for receiving a container and a metering station delimiting a chamber housing a support for receiving a collecting vessel, this support being positioned directly in line with and below at least one opening providing access to the chamber positioned in a so-called top part of the chamber, the machine also comprising a system for emptying each location for receiving a container configured to, at each receiving location, empty the product content of a container occupying said location through the at least one access opening formed in the top part of the chamber of the metering station and a unit driving the machine.

DESCRIPTION OF RELATED ART

Such a dispensing machine is known as illustrated for example by the patents EP 2 785 443 or EP 2 135 668 from the present applicant. Such machines can these days be used with products that can contain solvents. There is then a risk of creating an atex zone, that is to say a zone with explosive atmosphere, and the possibility for an operator of inhaling dangerous solvents when he removes the collecting vessel from the machine.

One aim of the invention is to propose a machine of the abovementioned type whose design makes it possible to limit the abovementioned risks without detracting from the simplicity of the machine.

OBJECTS AND SUMMARY

To this end, the subject of the invention is a machine for dispensing product, in particular liquid product, stored in a container, said machine comprising a storage zone delimiting a plurality of locations for receiving a container, a metering station delimiting a chamber housing a support for receiving a collecting vessel, this support being positioned directly in line with and below at least one opening for accessing the chamber positioned in a top part of the chamber, the machine also comprising a system for emptying each location for receiving a container through the at least one access opening formed in the top part of the chamber of the metering station and a unit driving the machine, characterized in that the metering station comprises at least one sensor for detecting presence of a collecting vessel inside said chamber, in that the driving unit is configured to control the machine at least as a function of the data supplied by the sensor for detecting presence of a collecting vessel inside said chamber and in that the metering station is equipped with a gaseous fluid circulation circuit connecting the chamber with the outside of said chamber, this fluid circulation circuit comprising a forced air circulation device or being equipped with a coupling that can be connected to a forced air circulation device.

The presence of a sensor for detecting presence of a collecting vessel inside the chamber can make it possible, according to one embodiment of the invention, to avoid a supply of product to the metering station when the collecting vessel is not present at the risk of generating a build-up of product and consequently of creating an explosive atmosphere inside the chamber.

The presence at the chamber, that is to say as close as possible to a potentially hazardous zone, of a gaseous fluid circulation circuit emerging outside the chamber, and preferably outside the machine for a circulation of the gaseous fluid in the direction of an extraction of the gases from the chamber can make it possible to avoid a build-up of gas inside the chamber at the risk once again of creating an explosive atmosphere inside the chamber.

According to an embodiment of the invention, the support for receiving a collecting vessel is mounted to be movable up and down inside the chamber in the direction toward or away from the at least one opening providing access to the chamber formed in the top part of the chamber of the metering station.

The creation of a movable support makes it possible to bring the collecting vessel of bucket type open at its top end as close as possible to the access opening formed in the top part of the chamber of the metering station so as to contain the gases emanating from the product inside the collecting vessel.

According to an embodiment of the invention, the machine comprises a device for holding the support for receiving a collecting vessel so as to hold said support in at least one of the positions that can be adopted by said support.

According to an embodiment of the invention, the sensor for detecting presence of a collecting vessel is positioned in the top half of the chamber of the metering station.

According to an embodiment of the invention, the support for receiving a collecting vessel is equipped with a weighing system and the or at least one of the sensors for detecting presence of a collecting vessel is incorporated in the weighing system. The result thereof is a simplification of the machine.

According to an embodiment of the invention, the sensor for detecting presence of a collecting vessel is a sensor comprising two parts positioned facing one another in the top half of the chamber of the metering station. This sensor can be an optical sensor, an inductive sensor or the like.

According to an embodiment of the invention, the gaseous fluid circulation circuit connecting the chamber with the outside of the chamber comprises at least one member for blocking off the circuit and the unit driving the machine is configured to control the displacement of the blocking member between a closed position and an open position. It is thus possible to avoid a permanent extraction of the gases contained inside the chamber.

According to an embodiment of the invention, the unit driving the machine is configured to control the displacement of the member for blocking off the gaseous fluid circulation circuit connecting the chamber with the outside of said chamber between a closed position and an open position at least as a function of data supplied by the sensor for detecting presence of a collecting vessel inside said chamber. Thus, an extraction of the gases from the chamber is done only when the collecting vessel is present suggesting that a metering operation is currently underway.

According to an embodiment of the invention, the support for receiving a collecting vessel being equipped with a weighing system, the unit driving the machine is configured to control the displacement of the member for blocking off the gaseous fluid circulation circuit connecting the chamber with the outside of said chamber between a closed position and an open position as a function at least of data supplied by the weighing system.

According to an embodiment of the invention, the chamber of the metering station comprises a sensor for detecting volatile organic compounds and the unit driving the machine is configured to control the member for blocking off the gaseous fluid circulation circuit connecting the chamber with the outside of said chamber as a function of data supplied by the sensor for detecting volatile organic compounds inside said chamber.

By virtue of this design, the extraction of the gases can be activated only when necessary. Emergency measures can also be triggered in the case of volatile organic compound concentration values above a predetermined threshold value.

According to an embodiment of the invention, the gaseous fluid circulation circuit connecting the chamber with the outside of the chamber comprises a branch connecting the circuit to a forced air circulation device, the member for blocking off the circuit is positioned on said branch and this blockable branch of the circuit is equipped, in its zone of connection to a so-called main branch of the circuit, with a venturi system.

According to an embodiment of the invention, the gaseous fluid circulation circuit connecting the chamber with the outside of said chamber is connected to the chamber at the opening providing access to the chamber positioned in the top part of the chamber and emerges in said opening. Thus, it is possible, when the support for receiving a collecting vessel is mounted to be movable up and down, to bring the collecting vessel as close as possible to the access opening formed in the top part of the chamber of the metering station such that the top end of the collecting vessel, such as a bucket or equivalent, surrounds the access opening formed in the top part of the chamber. The gases emanating from the product are thus contained inside the collecting vessel. The forced circulation of gaseous fluid in the circuit emerging in the chamber in the opening providing access to the chamber allows for an immediate extraction of the gases contained in the collecting vessel without these gases spreading through the chamber. The result thereof is a more effective extraction of the vapors.

According to an embodiment of the invention, the locations for receiving a container are mounted on a support frame and the support frame and the chamber of the metering station are mounted to be movable relative to one another.

According to an embodiment, the chamber of the metering station is mounted to be movable up and down in the direction toward or away from the storage zone. Thus, at least a part of the emptying system can be located on the chamber. The emptying is done only when the chamber is correctly positioned.

According to an embodiment of the invention, the emptying system comprises a device controlling the opening/closing of a container positioned around the at least one opening providing access to the chamber positioned in the top part of the chamber, and a device supplying air under pressure that can be connected to a source of air under pressure and that is configured to supply air under pressure to the storage zone.

Another subject of the invention is a method for controlling operation of a machine for dispensing a product of the abovementioned type, characterized in that said method comprises at least a step of detection of presence of a collecting vessel inside said chamber and a step of forced circulation of gaseous fluid in the gaseous fluid circulation circuit connecting the chamber with the outside of said chamber, in particular with the outside of the machine.

BRIEF DESCRIPTION OF DRAWINGS

The invention will be well understood on reading the following description of exemplary embodiments, with reference to the attached drawings in which.

DETAILED DESCRIPTION

Figure 1A:
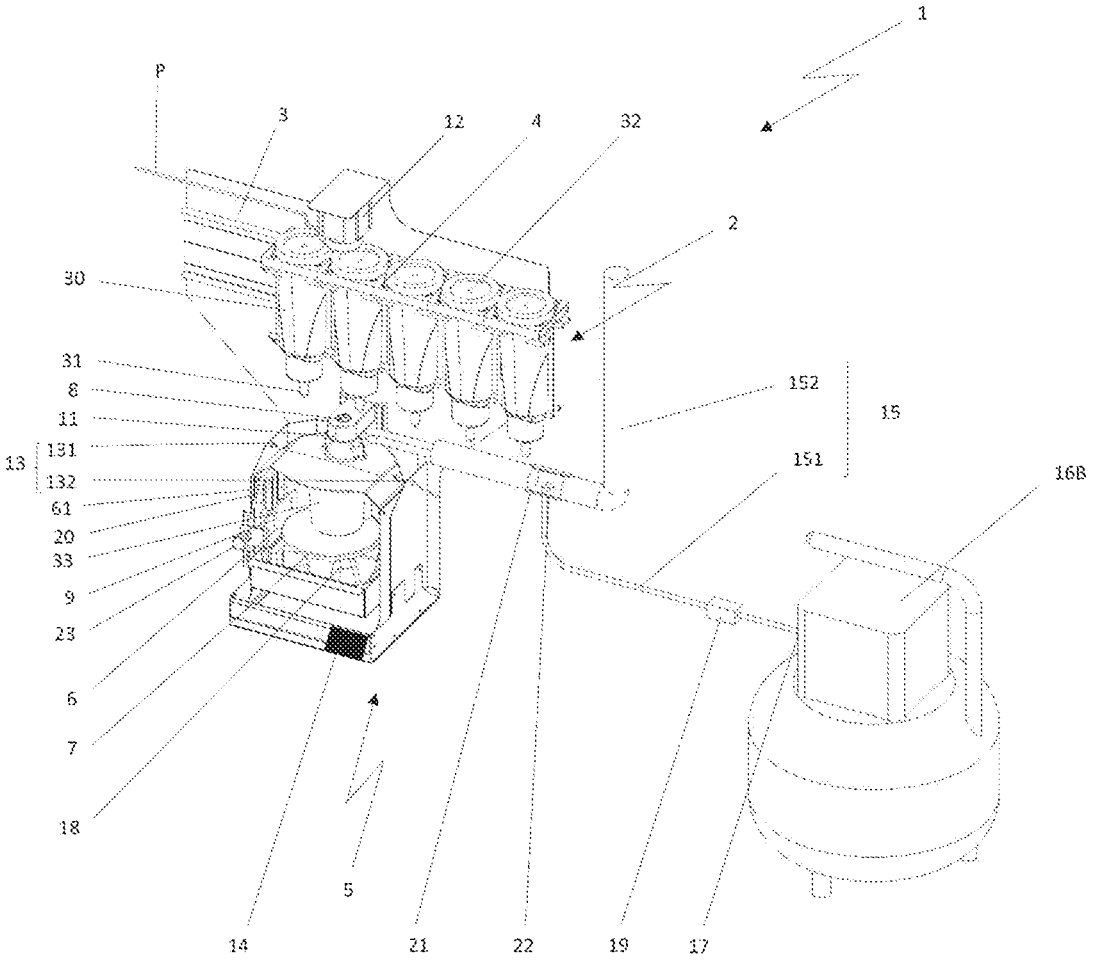
FIG. 1A represents a partial perspective view of a machine according to the invention, the support frame being able to be displaced in translation and the forced air circulation device being able to be connected to the machine.

As mentioned above, the product dispensing machine 1, which is the subject of the invention, is more particularly intended to allow product, in particular liquid or pasty product, stored in a container 30, and that can contain volatile organic compounds, to be dispensed. Such a machine 1 also allows for product mixtures to be produced and is applicable in the preparation of paint tints from a series of paints each stored in a container 30.

This machine 1 comprises a storage zone 2 delimiting a plurality of locations 4 each for receiving a container 30. These locations 4 for receiving a container 30 are each positioned on a support frame 3. These locations 4, such as cells, are positioned side-by-side on the support frame 3 which can take a large number of forms. Generally, this support frame 3 is a movable frame equipped with a displacement driving system comprising at least one actuator, such as a motor or a cylinder. In the example represented in FIGS. 1A and 1B, the support frame 3 is mounted to be movable in translation with a reciprocating movement whereas, in FIG. 2, the support frame 3 is a rotary support frame 3 mounted to rotate about a so-called horizontal axis. In this embodiment, the support frame 3 takes the form of a wheel and the system driving the rotation of the support frame 3 can be of the type of that described for example in the European patent EP-2.785.443, in which motorized rotary pinions with which the machine is equipped engage with toothing of the support frame 3. Each container 30 that can be positioned inside a receiving location 4 can comprise a deformable flexible pouch equipped with an emptying valve 31 provided with an orifice for expelling the fluid contained inside the pouch. The emptying valve can be of the type of that described in the patent EP-1.975.486 and the emptying of the flexible pouch can be done by deforming the flexible pouch and opening the emptying valve using an emptying system 10 with which the machine 1 is equipped. The machine 1 comprises, for switching of the emptying valve of each container 30 from a closed position to an open position and vice versa, a device 11 controlling opening/closing and, for deforming the pouch of each container 30, a device 12 supplying air under pressure that can be connected to a source P of air under pressure and that is configured to supply air under pressure to the storage zone 2 via an air intake opening 32 formed at each location on the container 30 or on the machine in the case of a container housed at least partially inside a closed cell. An example of such a device 12 supplying air under pressure capable of allowing the deformation of the pouch of the container 30 that has to be emptied is described in the patent EP-2.785.443 and will not therefore be detailed hereinbelow.

The device 11 for controlling opening/closing of a container 30 is, for its part, positioned on a metering station 5 of the machine. In fact, the product dispensing machine 1 comprises, in addition to the storage zone for the containers 30, a metering station 5 delimiting a chamber 6 housing a support 7 for receiving a collecting vessel 33, such as a bucket or the like, this support 7 being positioned vertically in line with and below at least one opening 8 providing access to the chamber 6 positioned in a so-called top part 61 of the chamber 6 in the zone called ceiling of said chamber 6.

In the case of a support frame 3 in the form of a wheel, the metering station 5 can be positioned inside the wheel.

In the case of a support frame 3 mounted to be movable by reciprocating movement and formed by a plurality of locations 4 for receiving a container 30 that are positioned side-by-side along a horizontal line, the metering station 5 is positioned under the support frame 3. The emptying system 10 of each location 4 for receiving a container 30 is configured to allow the container of each receiving location 4 positioned opposite the access opening 8 formed in the top part 61 of the chamber 6 to be emptied. To this end, the device 11 controlling opening/closing of a container 30 is positioned around the opening 8 providing access to the chamber 6, which is itself positioned in the top part 61 of the chamber 6. This device 11 controlling opening/closing of the emptying valve with which the container 30 is equipped, the associated container receiving location being positioned above and facing the collecting vessel 33, such as a bucket, can comprise a cylindrical coil, such as a solenoid capable of inducing a magnetic field at the emptying valve with which the container is equipped. The detail of operation of such a device is described in the patent EP-1.975.486.

To allow any one of the locations 4 for receiving a container to be brought into position facing the access opening 8 formed in the top part 61 of the chamber 6 of the metering station 5 in order for the container associated with said receiving location 4 to be emptied, the support frame 3 and the chamber 6 of the metering station 5 are mounted to be movable relative to one another.

As described above, the support frame 3 can be movable. The chamber 6 of the metering station is also generally mounted to be movable up and down to allow the device 11 controlling opening/closing of a container, positioned on the chamber 6 outside the chamber 6, around the access opening 8 formed in the top part of the chamber 6, to cap the emptying valve of the container to be emptied. This driving of the up and down displacement of the chamber 6 of the metering station 5 can be done using an actuator, such as a cylinder or a motor.

The product dispensing machine 1 also comprises a unit 14 driving the machine, and in particular the system driving displacement of the support frame 3 and the chamber 6 of the metering station 5 and the emptying system 10. This driving unit 14 can take the form of an electronic and computing system which comprises, for example, a microprocessor and a working memory. According to a particular aspect, the driving unit can take the form of a programmable logic controller.

In other words, the functions and steps described can be implemented in the form of a computer program or via hardware components (e.g. programmable gate arrays). In particular, the functions and steps applied by the driving unit or its modules can be performed by instruction sets or computing modules implemented in a processor or controller or be realized by dedicated electronic components or components of FPGA or ASIC type. It is also possible to combine computing parts and electronic parts.

When it is specified that the unit or means or modules of said unit are configured to perform a given operation, that means that the unit comprises computing instructions and the corresponding execution means which allow said operation to be performed and/or that the unit comprises corresponding electronic components.

In a way that is characteristic of the invention, the metering station 5 comprises at least one sensor 13 detecting presence of a collecting vessel 33 inside said chamber 6. This collecting vessel 33 is introduced into the chamber 6 through an opening 9 of the chamber 6 positioned generally on the front of the chamber 6. The driving unit 14 is configured to control the machine 1 at least as a function of the data supplied by the sensor 13 detecting presence of a collecting vessel 33 inside said chamber 6. In particular, the driving unit 14 is configured to prevent the operation of the emptying system 10 if a state of absence of the collecting vessel 33 inside said chamber is detected by the sensor 13 detecting presence of said collecting vessel 33. This sensor 13 for detecting presence prevents a container associated with a receiving location 4 positioned facing the opening 8 providing access to the chamber 6 from being ordered to be emptied in the absence of a collecting vessel 33 on the support 7 for receiving the collecting vessel 33.

Figure 2:
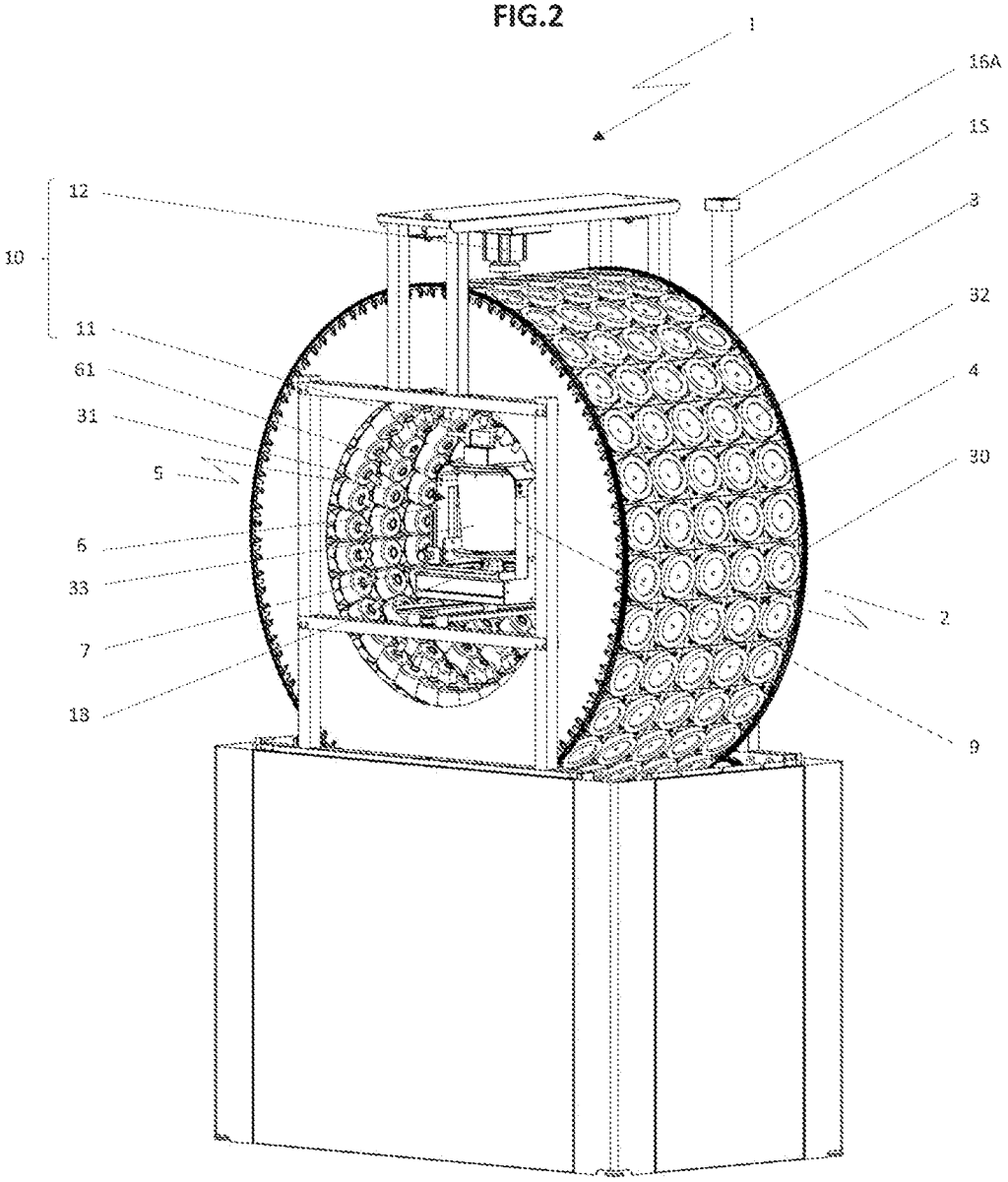
FIG. 2 represents a perspective view of a machine according to the invention, the support frame being able to be displaced in rotation.
Figure 3:
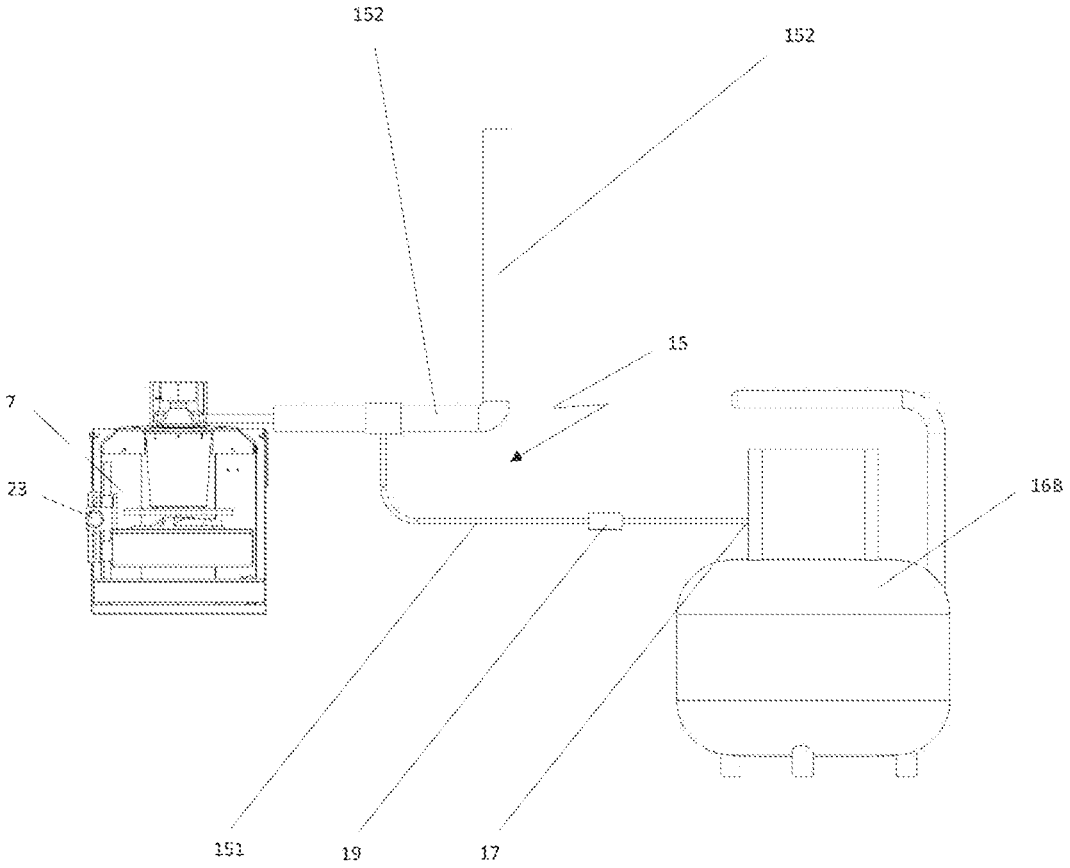
FIG. 3 represents a partial schematic view of a metering station with the support receiving the collecting vessel in high position.
Figure 4:
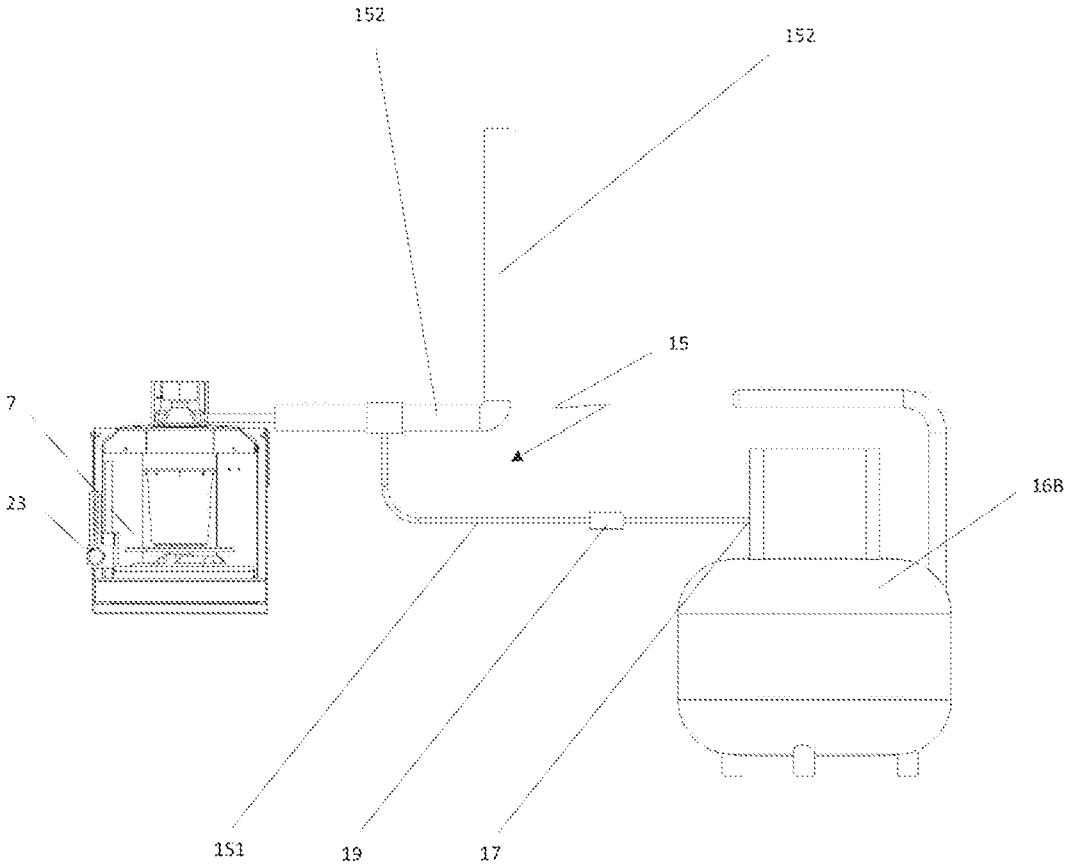
FIG. 4 represents a partial schematic view of a metering station with the support receiving the collecting vessel in low position.
Figure 5:
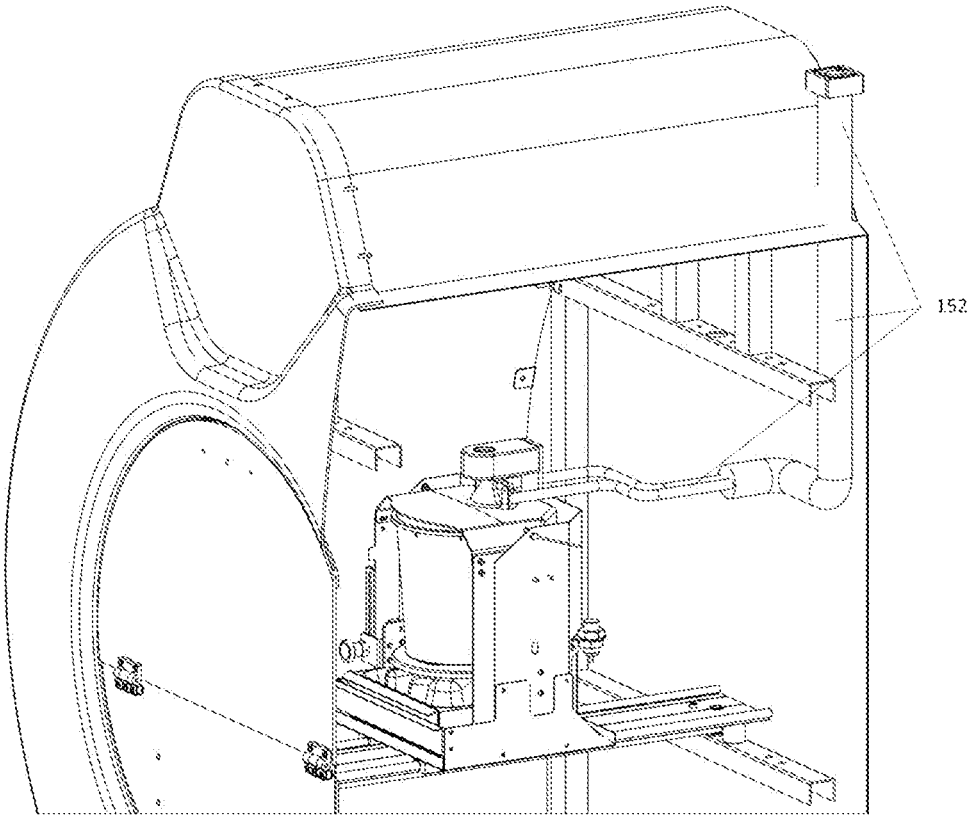
FIG. 5 represents a partial schematic view from the inside of the support frame.

In the example represented, this support 7 for receiving the collecting vessel 33 is formed by a plate positioned inside the chamber 6. This support 7 for receiving a collecting vessel 33 is equipped with a weighing system 18, such as a spring balance or a weighing sensor. The detection sensor 13 can be positioned in the upper half of the chamber 6 of the metering station 5 as illustrated in FIG. 1A. In this embodiment, the sensor 13 for detecting presence of a collecting vessel 33 is a sensor comprising two parts 131, 132 positioned facing one another in the top half of the chamber 6 of the metering station 5. Here, this sensor is an optical sensor, but it could also, in an equivalent manner, be produced in the form of an analog sensor.

As a variant, or in addition, the sensor 13 can be incorporated in the weighing system 18. The support 7 for receiving a collecting vessel 33 can also be mounted to be movable up and down inside the chamber 6 in the direction toward or away from the opening 8 providing access to the chamber 6 formed in the top part 61 of the chamber 6 of the metering station 5 vertically above the support 7 for receiving the collecting vessel 33. The up and down displacement of the support 7 for receiving a collecting vessel 33 makes it possible to bring the open top of the collecting vessel 33 as close as possible to the ceiling of the chamber 6 of the metering station 5 to avoid having vapors of volatile organic compounds spread throughout the chamber during the transfer of fluid from a location 4 for receiving a container of the support frame 3 to the collecting vessel 33 of the chamber 6 of the metering station 5. The driving of the up and down displacement of the support 7 for receiving a collecting vessel 33 can be done manually, for example by sliding displacement of the support 7 along so-called vertical rails positioned inside the chamber 6 and a device 23 for holding the support 7 in position can be provided. This device 23 for holding the support for receiving a collecting vessel 33 in position can, as in the example represented in FIG. 1B, be formed by sprung knob secured in displacement to the support 7, this sprung knob being latched in one of the notches of a series of notches positioned on a wall of the chamber along a line parallel to the direction of up and down displacement of the support 7. As a variant, the support 7 for receiving a collecting vessel 33 can be mounted to be movable up and down using an actuator, such as a cylinder. In this case, the actuator also serves as device for holding the support 7 in any one of the positions that can be adopted by said support 7.

Figure 1B:
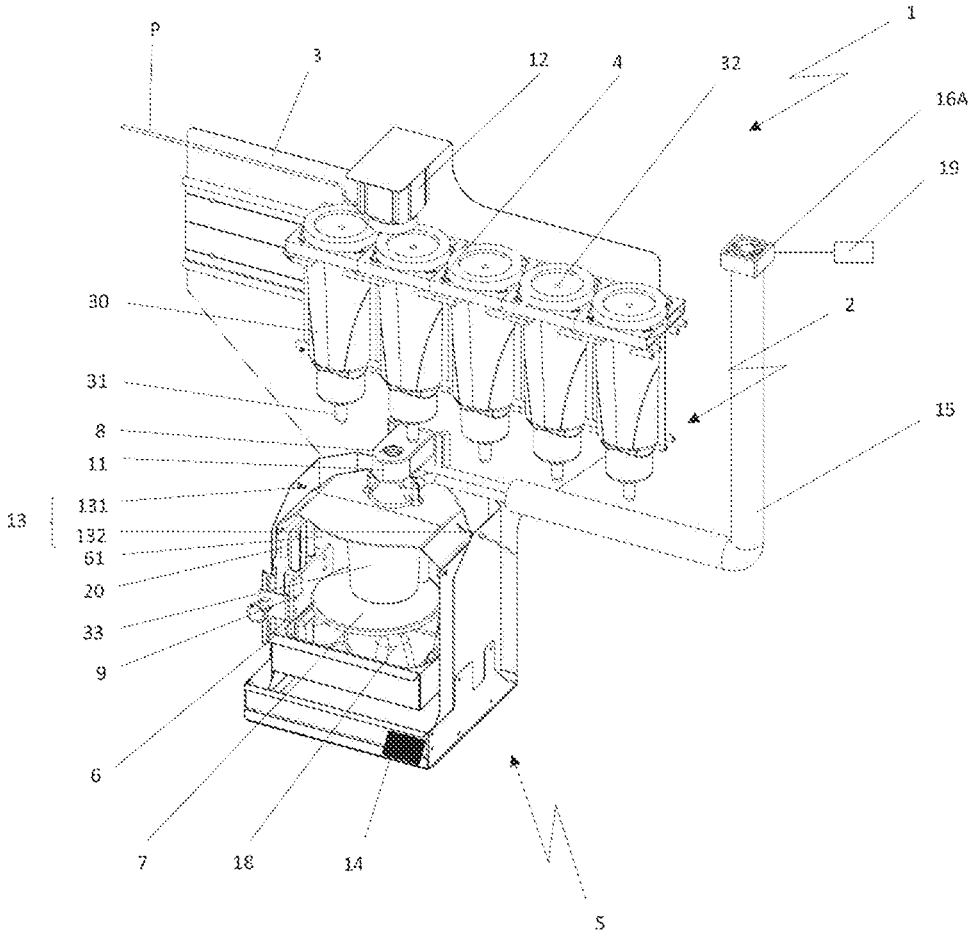
FIG. 1B represents a partial perspective view of a machine according to the invention, the support frame being able to be displaced in translation and the forced air circulation device being incorporated in the machine.

To refine the assembly, the metering station 5 of the product dispensing machine 1 is equipped with a gaseous fluid circulation circuit 15 connecting the chamber 6 with the outside of said chamber 6. This fluid circulation circuit 15 comprises a forced air circulation device 16A or is equipped with a coupling 17 that can be connected to a forced air circulation device 16B as illustrated in FIG. 1A. In the case of a forced air circulation device 16A incorporated in the dispensing machine 1 as illustrated in FIG. 1B, this forced air circulation device 16A can be formed by a simple fan positioned on the gaseous fluid circulation circuit 15 connecting the chamber 6 with the outside of the chamber 6.

In the case of a forced air circulation device 16B that can be connected to the product dispensing machine 1, this forced air circulation device 16B can be formed by a compressed air network or a generator of air under pressure, such as a compressor. Independently of the design of the forced air circulation device 16A or 16B, the gaseous fluid circulation circuit 15 connecting the chamber 6 with the outside of the chamber 6, in particular with the outside of the machine, is connected to the chamber 6 at the opening 8 providing access to the chamber positioned in the top part of the chamber and emerges in said opening. This gaseous fluid circulation circuit 15 comprises at least one member 19 for blocking off the circuit 15 and the unit 14 driving the machine 1 is configured to control the displacement of the blocking member 19 between a closed position and an open position, preferably, at least as a function of the data supplied by the sensor 13 detecting presence of a collecting vessel 33 inside said chamber 6. Thus, the driving unit 14 can be configured to, in the absence of detection of a collecting vessel 33 inside the chamber 6, keep the member 19 for blocking off the gaseous fluid circulation circuit 15 connecting the chamber 6 with the outside of the chamber 6 in closed position.

In the case of a forced air circulation device 16A incorporated in the product dispensing machine 1 and formed by at least one fan, the driving unit 14 can be configured to control the operation of the fan only when the state of a collecting vessel 33 on the support 7 for receiving such a vessel is detected.

In the example represented in FIG. 1A, the gaseous fluid circulation circuit 15 connecting the chamber 6 with the outside of the chamber 6 in the direction of circulation of the gaseous fluid toward the outside of the chamber 6, in particular toward the outside of the machine, comprises a branch 151 for connecting the circuit 15 to a forced air circulation device 16B. The member 19 for blocking off the circuit 15 is positioned on said branch 151. This blockable branch 151 of the circuit 15 is equipped, in its zone 21 of connection to a so-called main branch 152 of the circuit 15, with a venturi system 22.

To refine the assembly the chamber 6 of the metering station 5 can comprise a sensor 20 for detecting volatile organic compounds. In this case, the unit 14 driving the machine is configured to control the member 19 for blocking off the gaseous fluid circulation circuit 15 connecting the chamber 6 with the outside of said chamber 6 as a function of the data supplied by the sensor 20 for detecting volatile organic compounds inside said chamber.

The method for controlling operation of a dispensing machine 1, as described above, can therefore comprise at least a step of detection of presence of a collecting vessel 33 inside said chamber 6 and a step of forced circulation of gaseous fluid in the gaseous fluid circulation circuit 15 connecting the chamber 6 with the outside of said chamber 6. This method also comprises at least a step of driving the upward displacement of the support 7 for receiving a collecting vessel 33 in the direction toward the access opening 8 formed in the top part 61 of the chamber 6 of the metering station 5. This displacement allows the top of the collecting vessel 33 to be brought to bear on the ceiling of the chamber 6 such that the solvent vapors are contained in the collecting vessel 33.

This method also comprises at least a step of driving upward displacement of the chamber 6 of the metering station in the direction toward the storage zone 2.

This method also comprises, for the implementation of the step of forced circulation of gaseous fluid in the gaseous fluid circulation circuit 15, at least a step of opening the blocking member with which said circuit is equipped and, if necessary, a step of starting up the forced air circulation device 16A or 16B.

In detail, the operation of a dispensing machine, as described above, can be as follows. It is assumed that a container has been preselected automatically by an operator via, for example, a human/machine interface with which said machine 1 is equipped. The location 4 for receiving the associated container 30 is positioned above and facing the access opening 8 formed in the top part 61 of the chamber 6 of the metering station 5 in order for the container to be partially or totally emptied. A collecting vessel 33 is introduced inside the chamber 6 via an input opening in the chamber 6 and is positioned inside the chamber 6 on the support 7 for receiving a collecting vessel 33. The support 7 is, if necessary, raised to bring the top of the collecting vessel 33 as close as possible to the ceiling of the chamber 6 such that the edge of the opening of the collecting vessel 33 surrounds the access opening 8 formed in the top part 61 of the chamber 6 of the metering station 5. This collecting vessel 33 is detected by the presence detecting sensor 13. The chamber 6 of the metering station is raised to allow the device 11 controlling opening/closing of a container 30 to surround the emptying valve 31 of the container, this valve 31 being partially housed in the opening 8 providing access to the chamber 6. A compression is applied via the device 12 supplying air under pressure to the flexible pouch constituting the container 33 to allow the emptying thereof when the emptying valve of the container is in the open state, ordered to open by the opening/closing control device 11. The valve is open for a control time based on the data from the weighing applied continually by the weighing system 18 until the exact required weight is obtained. The valve can then be closed. The pressure is maintained on the flexible pouch of the container 30 at least throughout the emptying phase. Once the emptying is completed and the emptying valve 31 is closed, the chamber 6 can be lowered back. A new emptying can be done after a new container has been selected by repetition of the operations described above. During emptying, the forced air circulation device 16A or 16B can be activated and the device 19 for blocking off the gaseous fluid circulation circuit 15 connecting the chamber 6 with the outside of the chamber 6, when present, can be opened to allow a discharging of at least a part of the content of the chamber 6, that is to say of the volume of the chamber 6 containing volatile organic compounds, to the outside of the chamber 6 to avoid any risk of explosion. The driving of the member 19 for blocking off the gaseous fluid circulation circuit 15 connecting the chamber 6 with the outside of the chamber 6 and/or of the forced air circulation device 16A or 16B can be refined using the sensor 20 for detecting volatile organic compounds when such a sensor is provided, or using the weighing system 18.

The member 19 for blocking off the gaseous fluid circulation circuit 15 connecting the chamber 6 with the outside of the chamber 6 can thus be closed before the end of the weighing, when there are still a few grams to be weighed, to avoid air flows which could disturb or hamper the accuracy of the metering.

The invention claimed is:

1. A machine for dispensing a liquid product, stored in a container, said machine comprising:

a storage zone delimiting a plurality of locations for receiving a container, a metering station delimiting a chamber housing a support for receiving a collecting vessel, the support being positioned vertically in line with and below at least one opening providing access to the chamber, positioned in a top part of the chamber, the machine also comprising a system for emptying each location for receiving a container through the at least one access opening formed in the top part of the chamber of the metering station and a unit for driving the machine, wherein the metering station comprises at least one sensor for detecting presence of a collecting vessel inside said chamber, in that the driving unit is configured to control the machine at least as a function of the data supplied by the sensor for detecting presence of a collecting vessel inside said chamber and in that the metering station is equipped with a gaseous fluid circulation circuit connecting the chamber with the outside of said chamber, the gaseous fluid circulation circuit having either a forced air circulation device or having a coupling that can be connected to an external forced air circulation device, wherein the gaseous fluid circulation circuit connecting the chamber with the outside of said chamber is connected to the chamber at the opening providing access to the chamber positioned in the top part of the chamber and emerges in said opening.

2. The machine for dispensing fluid product stored in a container as claimed in claim 1, wherein the support for receiving a collecting vessel is mounted to be movable up and down inside the chamber in the direction toward or away from the at least one opening providing access to the chamber formed in the top part of the chamber of the metering station.

3. The machine for dispensing fluid product stored in a container as claimed in claim 1, wherein the sensor for detecting presence of a collecting vessel is positioned in the top half of the chamber of the metering station.

4. The machine for dispensing fluid product stored in a container as claimed in claim 1, wherein the support for receiving a collecting vessel is equipped with a weighing system and in that the or at least one of the sensors for detecting presence of a collecting vessel is incorporated in the weighing system.

5. The machine for dispensing fluid product stored in a container as claimed in claim 1, wherein the sensor for detecting presence of a collecting vessel is a sensor comprising two parts positioned facing one another in the top half of the chamber of the metering station.

6. The machine for dispensing fluid product stored in a container as claimed in claim 1, wherein the gaseous fluid circulation circuit connecting the chamber with the outside of the chamber comprises at least one member for blocking off the circuit and in that the unit driving the machine is configured to control the displacement of the blocking member between a closed position and an open position.

7. The machine for dispensing fluid product stored in a container as claimed in claim 6, wherein the unit driving the machine is configured to control the displacement of the member for blocking off the gaseous fluid circulation circuit connecting the chamber with the outside of said chamber between a closed position and an open position as a function of data supplied by the sensor for detecting presence of a collecting vessel inside said chamber.

8. The machine for dispensing fluid product stored in a container as claimed in claim 6, wherein, the support for receiving a collecting vessel being equipped with a weighing system, the unit driving the machine is configured to control the displacement of the member for blocking off the gaseous fluid circulation circuit connecting the chamber with the outside of said chamber between a closed position and an open position as a function of at least data supplied by the weighing system.

9. The machine for dispensing fluid product stored in a container as claimed in claim 6, wherein the chamber of the metering station comprises a sensor for detecting volatile organic compounds and in that the unit driving the machine is configured to control the member for blocking off the gaseous fluid circulation circuit connecting the chamber with the outside of said chamber as a function of data supplied by the sensor for detecting volatile organic compounds inside said chamber.

10. The machine for dispensing fluid product stored in a container as claimed in claim 6, wherein the gaseous fluid circulation circuit connecting the chamber with the outside of the chamber comprises a branch connecting the circuit to a forced air circulation device, in that the member for blocking off the circuit is positioned on said branch and in that this blockable branch of the circuit is equipped, in a zone of connection to a so-called main branch of the circuit, with a venturi system.

11. The machine for dispensing fluid product stored in a container as claimed in claim 1, wherein the locations for receiving a container are mounted on a support frame and in that the support frame and the chamber of the metering station are mounted to be movable relative to one another.

12. The machine for dispensing fluid product stored in a container as claimed in claim 1, wherein the chamber of the metering station is mounted to be movable up and down in the direction toward or away from the storage zone.

13. The machine for dispensing fluid product stored in a container as claimed in claim 1, wherein the emptying system comprises a device for controlling the opening/closing of a container positioned around the at least one opening providing access to the chamber positioned in the top part of the chamber, and a device for supplying air under pressure that can be connected to a source of air under pressure and that is configured to supply air under pressure to the storage zone.

14. A method for controlling the operation of a product dispensing machine conforming to claim 1, wherein said method comprises at least a step of detection of presence of a collecting vessel inside said chamber and a step of forced circulation of gaseous fluid in the gaseous fluid circulation circuit connecting the chamber with the outside of said chamber.

* * * * *